United States Patent [19]

Hayashi et al.

[11] 4,109,038

[45] Aug. 22, 1978

[54] SUEDE-LIKE RAISED WOVEN FABRIC AND PROCESS FOR THE PREPARATION THEREOF

[75] Inventors: Kazushige Hayashi, Ibaraki; Iwao Fujimoto, Waki; Toshio Morishita, Iwakuni; Norihiro Minemura; Norio Yoshida, both of Ibaraki; Kiyotaka Ozaki, Iwakuni; Takanori Shinoki, Matsuyama, all of Japan

[73] Assignee: Teijin Limited, Osaka, Japan

[21] Appl. No.: 799,818

[22] Filed: May 23, 1977

[30] Foreign Application Priority Data

Mar. 17, 1977 [JP] Japan ..... 52-28627

[51] Int. Cl.[2] ..... B32B 7/00

[52] U.S. Cl. ..... 428/91; 28/162; 156/72; 156/148; 156/250; 428/253; 428/257; 428/258; 428/259; 428/272; 428/373; 428/398

[58] Field of Search ..... 428/91, 253, 257, 258, 428/259, 272, 370, 373, 395, 398, 178, 212; 264/150, 151, 177 F, 209, 210 F; 28/162; 156/72, 250, 148

[56] References Cited

U.S. PATENT DOCUMENTS

| | | | |
|---|---|---|---|
| 2,150,652 | 3/1939 | Foster | 428/91 |
| 2,390,386 | 12/1945 | Radford | 428/91 |
| 2,783,609 | 3/1957 | Breen | 28/252 |
| 3,865,678 | 2/1975 | Okamoto et al. | 428/91 |
| 3,933,965 | 1/1976 | Gallone et al. | 428/398 |
| 4,051,287 | 9/1977 | Hayashi et al. | 428/373 |

*Primary Examiner*—David Klein
*Assistant Examiner*—Michael W. Ball
*Attorney, Agent, or Firm*—Sughrue, Rothwell, Mion, Zinn and Macpeak

[57] ABSTRACT

A suede-like raised woven fabric which comprises: warp yarns; weft yarns, each being a single twist filament yarn or a loopy textured filament yarn consisting of a bundle of fine fibers; and an elastic polymer applied to the fabric. The bundle of fine fibers consists of a raised portion having an average monofilament denier of from 0.05 to 0.4 and an unraised portion having an average monofilament denier of above 0.4 but not exceeding 0.8. The raised woven fabric is prepared by weaving a fabric using as weft yarn a single twist filament yarn or a loopy textured filament yarn comprising hollow composite fibers, each composed of at least four alternately arranged components of fiber-forming polyester and fiber-forming polyamide which are mutually adhered side-by-side encompassing a hollow space and extend along the longitudinal axis of the fiber to form a tubular body, and dividing the hollow composite fibers into fine fibers to form a bundle of fine fibers consisting of raised and unraised portions by a raising operation. The raised woven fabric has a high density and excellent uniformity of the raised fine fibers, and has excellent suppleness, surface abrasion and pilling resistances.

12 Claims, 7 Drawing Figures

FIG. 5-a
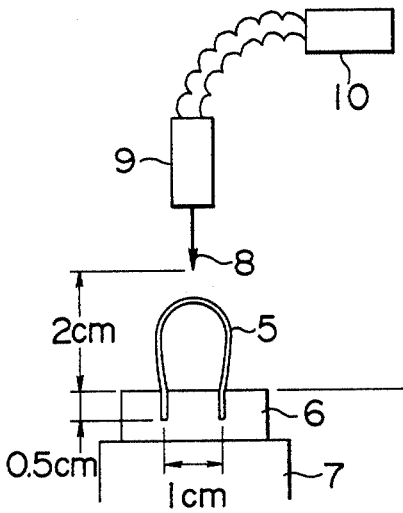
FIG. 5-b
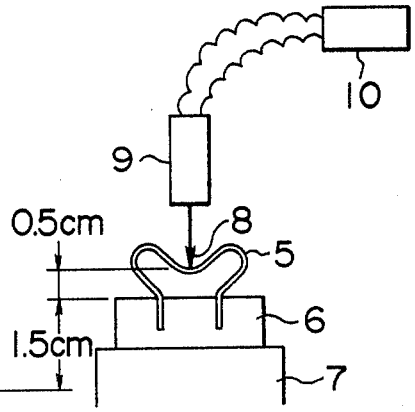
FIG. 5-c
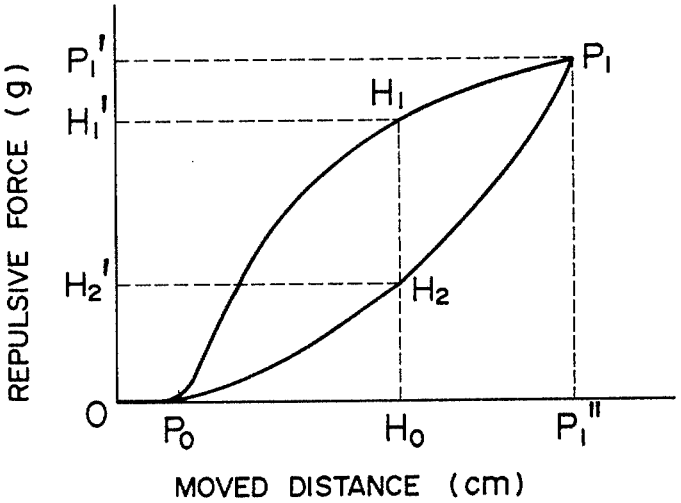

SUEDE-LIKE RAISED WOVEN FABRIC AND PROCESS FOR THE PREPARATION THEREOF

BACKGROUND OF THE INVENTION

1. Field of the Invention

The present invention relates to a suede-like raised woven fabric, and to a process for the preparation thereof. More particularly, the present invention is concerned with so-called suede cloth having a raised or soft fuzzy fibrous surface composed of numerous fine fibers, and with a process for producing the same.

2. Description of the Prior Art

Heretofore, suede-like raised woven fabrics comprising fine fibers have been known.

U.S. Pat. No. 3,865,678, issued on Feb. 11, 1975 to Okamoto et al, discloses a suede-like raised woven fabric which comprises raised fibers covering the surface of the woven fabric and an elastic polymer impregnated throughout the woven fabric. The woven fabric is made of a yarn or thread consisting of a bundle of extra fine fibers, the monofilament denier of which is in the range of from 0.0001 to 0.4 denier, as weft yarns, and a yarn having a coil-like crimp or a coil-like crimp capacity, the total denier of which ranges from 50 to 300 denier, as warp yarns, in which the raised fibers consist mainly of the extra fine fibers constituting the weft. This U.S. Patent discloses only "island-in-sea" type composite fibers or equivalent materials for generating the extra fine fibers. The island-in-sea type composite fiber can be converted into a bundle of the island component fibers by removing the sea component from the composite fiber. This type of composite fiber, however, is disadvantageous in that the sea component does not serve any purpose in the end use of the fiber as it has been removed. It is also disadvantageous in that removal of the sea component requires the use of an organic solvent. A further disadvantage of the use of island-in-sea type composite fibers is that removal of the sea component results in a considerable reduction in the weight, volume and density of the fiber article. The above-mentioned disadvantages, in turn, result in increased cost of end products formed from composite fibers and in difficulty in process control, environmental control and treatment of solvent waste. In addition, the suede-like raised woven fabric disclosed in this U.S. Patent is disadvantageout in that the surface abrasion and pilling resistances thereof are not satisfactory because of the poor fixation of the raised fibers. Since the bundle of the extra fine fibers has an extremely sharp monofilament denier distribution of between 0.0001 and 0.4 denier, the fabric also lacks suppleness.

In U.S. patent application Ser. No. 638,595 filed on Dec. 8, 1975 by K. Hayashi et al now U.S. Pat. No. 4,051,287, hollow composite fibers are disclosed, each being composed of at least four alternately arranged components of fiber-forming polyester and fiber-forming polyamide which are mutually adhered side-by-side and encompass a center hollow cavity and which extend along the longitudinal axis of the fiber to form a tubular body. Raised woven or knitted fabric of a suede finish is also disclosed as being produced therefrom. The hollow composite fibers do not have the drawbacks described for the island-in-sea type composite fibers. The suede-like raised woven fabric prepared from such hollow composite fibers has high resistance to surface abrasion and pilling. However, this U.S. Application neither takes into consideration the kinds of weft and warp yarns of the fabric nor specifies the average monofilament denier of fine fibers produced from the hollow composite fiber, with the consequence that the raised woven fabric disclosed in this prior application does not have satisfactory density and uniformity of the raised fine fibers or suppleness suited for commercial use.

SUMMARY OF THE INVENTION

The object of the present invention is to provide a suede-like raised woven fabric composed of the raised fine fibers in high density and excellent uniformity and having excellent suppleness, surface abrasion and pilling resistances.

The above-mentioned object can be attained by a suede-like raised woven fabric which comprises:

(a) warp yarns, the total denier of a single warp yarn ranging from 50 to 300 denier;

(b) weft yarns, a single weft yarn having a total denier of from 50 to 500, being made of a yarn selected from the group consisting of a single twist filament yarn and a loopy textured filament yarn, and constituted of a bundle of fine fibers, the bundle of fine fibers having raised and unraised portions, the average monofilament denier of the raised portion being in a range of from 0.05 to 0.4 denier and the average monofilament denier of the unraised portion being in a range of above 0.4 but not exceeding 0.8 denier; and (c) an elastic polymer applied to the fabric. The above suede-like raised woven fabric can be produced by the process of the present invention, which comprises the following steps:

(1) providing hollow composite fibers, each composed of at least four alternately arranged components of fiber-forming polyester and fiberforming polyamide which are mutually adhered side-by-side and encompass a hollow space, and which extend along the longitudinal axis of the fiber to form a tubular body, the composite fiber having a denier of from 1 to 10, and each component having a denier of from 0.05 to 0.4;

(2) forming the hollow composite fibers into a yarn selected from the group consisting of a single twist filament yarn and a loopy textured filament yarn having a size of from 50 to 500 denier;

(3) weaving a fabric whose weft is the yarn comprising the hollow composite fibers and whose warp is the yarn having a size of from 50 to 300 denier;

(4) dividing the hollow composite fibers constituting said weft yarn into fine fibers to form a bundle of fine fibers by a raising operation, wherein the bundle of fine fibers consists of raised and unraised portions, the average monifilament denier of the raised portion being in the range of from 0.05 to 0.4 denier and the average monofilament denier of the unraised portion being in a range of above 0.4 but not exceeding 0.8 denier;

(5) applying a solution of an elastic polymer to the fabric; and (6) solidifying the elastic polymer as applied.

The foregoing object, other objects as well, specific constructions and textures of the suede cloth and the method of producing the same will become more apparent and understandable from the following detailed description thereof and the subsequent preferred examples thereof read with reference to the accompanying drawings.

BRIEF DESCRIPTION OF THE DRAWINGS

FIG. 5 is an explanatory view showing the method of measuring bending stiffness and resilience used herein.

DESCRIPTION OF THE PREFERRED EMBODIMENTS

Figure 1:
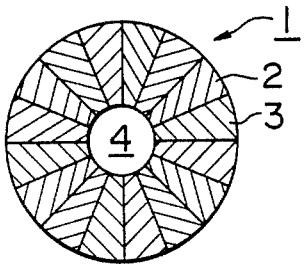
FIG. 1 is a schematic cross-sectional view of a hollow composite fiber of the present invention.

The weft yarn constituting the raised woven fabric of the present invention is a yarn selected from the group consisting of a single twist filament yarn and a loopy textured filament yarn constituted to a bundle of fine fibers. The term loopy textured filament yarn means a type of textured bulk yarn with randomly spaced loops inserted within individual filaments during passage through a special type of aspirator as disclosed in U.S. Pat. No. 2,783,609, Breen et al. This type yarn is commercially available as "Taslan", which is a trademark of du Pont. When a twin (two-folded) yarn or a triple (three-folded) yarn is used as the weft, the fabric cannot achieve the required high density and excellent uniformity in the raised fibers.

It is to be noted that when a spun yarn is used as the weft, uniformity and fixation of the raised fibers of the fabric are not good.

The number of twists of the single twist filament yarn may be from 50 to 500 turns/meter (T/m), preferably from 100 to 300 T/m.

Since a loopy textured filament yarn is formed from entangled filaments, it is similar to a single twist filament yarn. Therefore, a twisting operation is not necessary for a loopy textured filament yarn. In addition, a loopy textured filament yarn has the characteristics that it is easily raised because of the numerous loops thereof.

The total denier of the weft yarn consisting of a bundle of fine fibers is from 50 to 500 denier, preferably from 75 to 300 denier. When the denier is outside of this range, the characteristics of the suede-like raised woven fabric do not appear. The bundle of fine fibers consists of raised and unraised portions. The average monofilament denier of the raised portion must be in the range of from 0.05 to 0.4 denier, preferably from 0.1 to 0.3 denier. When the denier is less than 0.05 denier, the surface abrasion and pilling resistances of the fabric are not good. Further, process control for preparing the fine fibers is difficult. On the other hand, when the denier is more than 0.4 denier, the feel of the fabric tends to be rough and a suede-like touch is difficult to obtain. The average monofilament denier of the unraised portion must be in the range of above 0.4 but not exceeding 0.8 denier, preferably from 0.43 to 0.6 denier. When the denier is 0.4 denier and below, the suppleness of the fabric is not good. On the other hand, when the denier exceeds 0.8 denier, the feel of the fabric tends to be rough and a suede-like touch becomes difficult to obtain.

The average monofilament denier of the fine fiber is determined by conventional methods, or can be calculated from a cross-sectional micrograph of the weft yarn.

The weft yarn used in the present invention may be a yarn containing preferably not less than 80% by weight of a fiber of a type which generates fine fibers by splitting, a hollow composite fiber being an example thereof.

FIG. 1 shows one cross-section of a hollow composite fiber 1 used in the present invention, which is formed of a fiber-forming polyamide component 2, a fiberforming polyester component 3, and a center hollow space 4. The polyamide and polyester components 2 and 3 as well as the center hollow space 4 extend along the longitudinal axis of the fiber 1. The polyamide component 2 and the polyester component 3 are arranged alternately around the center hollow space 4 and mutually adhered side-by-side so as to form a tubular fiber body. In the embodiment of FIG. 1, hollow space 4 is formed around the longitudinal axis of the fiber 1, and the polyamide and polyester components 2 and 3 are regularly and alternately arranged around the center hollow space 4. However, the hollow space 4 may also be formed eccentrically with respect to the longitudinal axis, and the polyamide and polyester components 2 and 3 may be arranged around such an off-centered hollow space 4 to have irregular and different cross-sectional configurations and areas.

The hollow composite fiber of the present invention may be composed of at least 2, and preferably from 3 to 20, of the polyamide components and of the corresponding number of polyester components. The ratio of the total weight of the polyamide components to that of the polyester components is not limited, although a ratio of between 30:70 and 70:30 is preferable.

The fiber-forming polyester for the polyester component may be selected from the group consisting of (1) alkylene terephthalate homopolyesters, in which the alkylene group is derived from polymethylene glycol of the formula: $HO—(CH_2)_p—OH$, where p represents an integer of from 2 to 10 and (2) alkylene terephthalate — third ingredient copolyesters, in which the alkylene group is the same as defined above and the third ingredient is derived from at least one compound selected from the group consisting of adipic acid, sebacic acid, isophthalic acid, diphenylsulfone-dicarboxylic acid, naphthalenedicarboxylic acid, hydroxybenzoic acid, propylene glycol, cyclohexane-dimethanol and neopentyl glycol, in an amount of 10% or less by mole based on the amount of the alkylene terephthalate ingredient. The fiber-forming polyester for the polyester components may also be a blend of two or more of the above-mentioned homopolyesters and the copolyesters.

The fiber-forming polyamide for the polyamide components may be selected from the group consisting of nylon 4, nylon 6, nylon 66, nylon 7, nylon 610, nylon 11, nylon 12, polyamides of bis(p-aminocyclohexyl) methane with a dicarboxylic acid such as 1,7-heptanedicarboxylic acid and 1,10-decamethylenedicarboxylic acid, copolyamides of two or more of the above-mentioned polyamides and mixtures of two or more of the above-mentioned polyamides and copolyamides.

Both polyester and polyamide components, or any one of them, may contain therein an anti-static agent, a delustering agent such as titanium dioxide, a coloring agent such as carbon black, and an anti-oxidizing agent or thermal stabilizer.

In the present invention, it is preferable that the individual polyester and polyamide components in the composite fibers have a denier of from 0.05 to 0.4, or, more preferably, from 0.1 to 0.3. The composite fibers composed of the above-mentioned fine individual components are suitable for producing a suede-like fabric, the surface of which is covered with numerous fine fibers formed from these components as divided.

In the composite fiber of the present invention, there is no limitation on the hollow ratio, i.e., the ratio by volume of the hollow space to the sum of the volume of the polyamide and polyester components and the hollow space. It is, however, preferable that the hollow ratio be between 1 and 30% by volume, or more preferably, between 2 and 15% by volume. The hollow ratio can be determined by the following method. A cross-sectional profile at some point along the composite fiber is observed, from which the cross-sectional area of the hollow space and that of the fiber body are measured. The ratio of the cross-sectional area of the hollow space to that of the fiber body is determined from these measured values. The same procedures are repeated 20 times at different points along the fiber. The hollow ratio of the fiber represents a mean value of the determined values of the ratios. When the composite fibers have a hollow ratio of between 1 and 30% by volume, the composite fibers can be processed by, for example, a melt-spinning operation, a drawing operation, and a weaving operation without the individual components being separated from each other. Such composite fibers can be easily divided into fine fibers by a raising operation.

Figure 2:
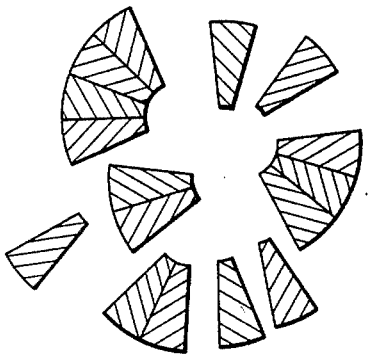
FIG. 2 is a schematic cross-sectional view of fine fibers which have been formed from a hollow composite fiber by a raising operation.

FIG. 2 shows a cross-section of fine fibers which were produced from a hollow composite fiber by a raising operation. When a woven fabric used in the present invention is subjected to a raising operation, the surface portion of the weft yarn comprising the hollow composite fibers is raised to form a raised portion, or a soft fuzzy fibrous surface, while the inner portion thereof is not raised, but the hollow composite fibers in this inner portion are divided into fine fibers to form an unraised portion due to mechanical force such as beating, rolling, and pulling imparted to them during the raising operation.

Figure 3:
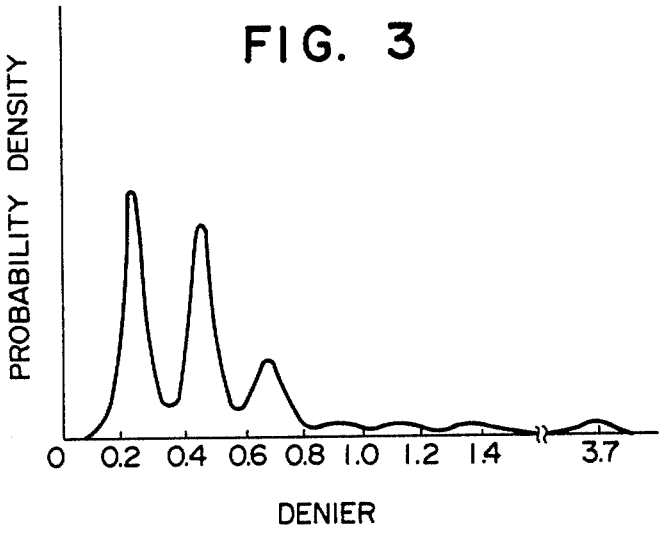
FIG. 3 is a graphical representation showing the monofilament denier distribution of fine fibers constituting unraised portions of a weft yarn of the raised woven fabric (in Example 1)

FIG. 3 shows a monofilament denier distribution of fine fibers which consitute the unraised portion of the weft yarn of the raised woven fabric obtained per Example 1.

The hollow composite fiber used in the present invention can be prepared by a method and apparatus as disclosed in afore-mentioned U.S. patent application Ser. No. 638,595, the disclosure of which is incorporated herein by reference.

The warp yarn used in the present invention is a yarn or thread, of which the total denier is from 50 to 300 denier, preferably from 75 to 250 denier. When the denier is outside of this range, the characteristics of the suede-like raised woven fabric do not appear. The warp yarn may be a filament yarn; a spun yarn; a textured filament yarn having crimps obtained by a method such as, false-twisting, stuffer crimping, edge crimping and air jet-crimping; a loopy textured filament yarn as disclosed in U.S. Pat. No. 2,783,609, Breen et al; a mixed filament yarn; and a mixed spun yarn. Particularly, as a warp yarn which can be used in the present invention, a textured filament yarn having crimps and a loopy textured filament yarn are preferable, because of the excellent feel, or suede finish, of the raised woven fabric. For the materials of warp yarn, there may be used a synthetic fiber such as polyester, polyamide and polyacrylonitrile, a semi-synthetic fiber such as a cellulose acetate, or a natural fiber such as wool and cotton. Particularly, polyethylene terephthalate is preferable.

In the woven fabric to be used in the present invention, there is no limitation with regard to the woven structure. It is, however, preferable that the woven structure be of a 3- to 9-ply satic structure, in which each weft yarn floats over 2 to 8 warp yarns, respectively. Especially, 3-ply to 5-ply satins are preferable because of their good appearance and properties as a suede-like fabric.

The woven fabric may be processed into the raised woven fabric of the present invention by any conventional process. For example, it can be processed in accordance with the process flow diagram shown in FIG. 4.

Figure 4:
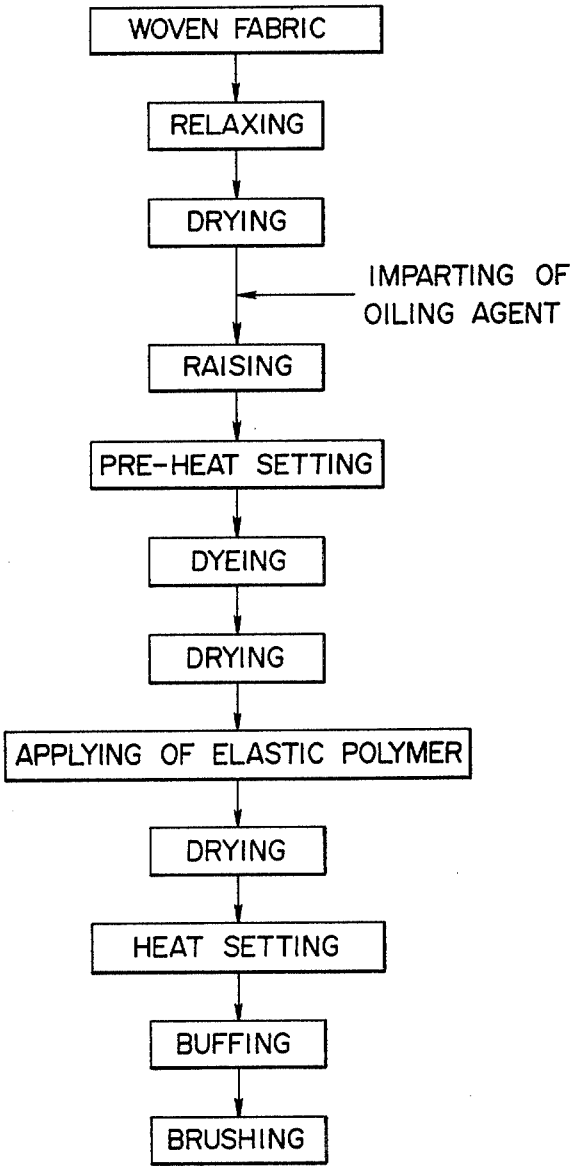
FIG. 4 is a process flow schematic of the present invention.

According to the process in FIG. 4, the woven fabric is relaxed by immersing it in a hot water bath at a temperature of from 40° to 100° C for a time period of from 30 seconds to 10 minutes. By means of this relaxing operation, the desired dimension and density of the woven fabric can be attained.

After drying, at least one surface of the woven fabric is raised by using a conventional raising machine such as emery raising machine, teazel raising machine, or wire raising machine. In the raising operation, the bristles of a raising machine, which may be stiff natural, synthetic, or metal bristles, raise fibers from the surface portion of the weft yarn so that they stand essentially upright to form the raised portion, while the inner portion of the weft yarn is not raised by the bristles but is divided into fine fibers by mechanical force of the raising operation to form the unraised portion. Passing through the raising machine several times, the surface portion of the weft yarn comprising the hollow composite fibers is raised to form the raised portion, in which the average monofilament denier of the resultant fine fibers is in the range of from 0.05 to 0.4 denier. The inner portion of the weft yarn is not raised, but is divided into fine fibers to form the unraised portion, in which the average monofilament denier of the resultant fine fibers is in the range of above 0.4 but not exceeding 0.8 denier.

The means and degree of the raising operation may be properly selected in accordance with the contemplated uses and objects.

The raised woven fabric is pre-heat set at a temperature of from 160° to 190° C for a time period of from 10 to 60 seconds with the fabric of a desired dimension. Thereafter, the raised woven fabric is dyed or printed using any conventional method. If desired or necessary, shering and/or brushing operations may be applied to the dyed or printed fabric.

After drying, the dyed or printed fabric is finished by applying a solution of an elastic polymer onto the fabric.

As useful elastic polymer, there are natural rubber and synthetic elastic polymers such as acrylonitrile-butadiene copolymers, polychloroprene, styrenebutadiene copolymers, polybutadiene, polyisoprene, ethylene-propylene copolymers, acrylate-type copolymers, silicone, polyurethanes, polyacrylates, polyvinyl acetate, polyvinyl chloride, polyester-polyether block copolymers, ethylenevinyl acetate copolymers, etc. Specifically, as the elastic polymer which can be used in the present invention, polyurethanes, polyacrylates, polyester-polyether block copolymers and ethylene-vinyl acetate copolymers are preferable.

A solution of an elastic polymer means an organic solvent solution, an aqueous solution or an aqueous emulsion of an elastic polymer. For applying a solution of an elastic polymer, there may be adopted a method of impregnating the raised woven fabric with the solution or a method of coating the solution onto the back-side surface (the surface not raised or less raised) of the raised woven fabric.

In the impregnating operation, it is preferable to use a solution of the elastic polymer having an elastic polymer concentration within a range of from 1 to 20% by weight of the solution. In the coating operation, it is preferable to use a solution of the elastic polymer having a concentration within a range of from 5 to 50% by weight, same basis. The amount of the elastic polymer (dry weight) applied to the fabric is determined in accordance with the required end use of the raised woven fabric. In an impregnated fabric, the preferable dry amount ranges from 1 to 20%, based on the weight of the fabric. In a coated fabric, the preferable dry amount ranges from 0.5 to 150%, based on the weight of the fabric.

After application, the elastic polymer is solidified or coagulated by any well-known method. For example, the impregnated fabric is dried and is then heat-set at a temperature at which the fabric is brought to the desired dimension. Thereafter, the heat-set fabric is buffed and brushed by any conventional method. If necessary, decatizing may be performed on the brushed fabric. In the resultant raised woven fabric of the present invention, the raised surface is covered with numerous fine fibers.

As stated hereinbefore, the hollow composite fibers usable for the present invention can be easily divided into a plurality of fine fibers by the raising operation. In addition, they are not divided to any substantial extent by normal melt-spinning, drawing, or weaving operations, so that the hollow composite fibers can be safely passed through the above-mentioned fiber forming and weaving operations without any risk of premature breakage or separation.

The relaxing operation serves to promote the dividing of the composite fibers. For this purpose, it is preferable to effect the relaxing operation to such a degree that the composite fibers are shrunk with a shrinkage of 20% or less, more preferably, from 5 to 15%. Since the thermal shrinking property of the polyamide components is different from that of the polyester components, the above-mentioned shrinking of the hollow composite fibers results in the creation of stress at interfaces between the polyamide and polyester components, which stress is effective for promoting the separation of the components.

The raised woven fabric of the present invention has wide varieties of use as clothing, for example, jackets, skirts, trousers, shorts, slacks, dresses, suits, vests, coats, and gloves.

The following examples are illustrative of the present invention, but are not to be construed as limiting the scope of the present invention.

EXAMPLE 1

As a warp yarn, there was used a twin filament yarn (200 denier) consisting of two 100 denier/24 filament wooly (false twisted) yarns of polyethylene terephthalate having a twist number of S 150 T/m.

As a weft yarn, a single twist filament yarn of hollow composite fibers was used. The particulars of the hollow composite fiber and the weft yarn were as follows:

Polyester component: polyethylene terephthalate (The intrinsic viscosity determined in O-chlorophenol at a temperature of 35° C is 0.62.)

Number of polyester components: 8

Denier of individual polyester component: 0.23 denier

Weight percentage of polyester components: 50%

Polyamide component: poly-ε-caproamide (Nylon 6) (The intrinsic viscosity determined in m-cresol at a temperature of 35° C is 1.30.)

Number of polyamide components: 8

Denier of individual polyamide component: 0.23 denier

Weight percentage of polyamide components: 50%

Hollow ratio: 8%

Denier of an individual hollow composite fiber: 3.7 denier

Total denier of a weft yarn: 300 denier (80 filaments)

Number of twists of a weft yarn: S 120 T/m

A 4-ply satin was prepared from the warp and weft yarns, the woven density of which was 70 warps/inch and 56 wefts/inch.

The resultant woven fabric was processed in accordance with the process flow diagram shown in FIG. 4. The fabric was relaxed in a hot water bath at a temperature of 100° C for 30 minutes, and dried at a temperature of 120° C for 3 minutes. An oiling agent mainly containing mineral oil was applied to the dried fabric. Thereafter, the fabric was raised 15 times with a wire raising macine having a plurality of 33 count wires at a running speed of 30 m/minute. The raised fabric was then preheat set at a temperature of 170° C for 30 seconds using a pin tenter type heat setter.

Thereafter, the pre-heat set fabric was dyed at a temperature of 130° C for 60 minutes in an aqueous dyeing bath containing 4% (based on the weight of the fabric) of Duranol Blue G (C.I. No. 63305, trademark for a disperse dye produced by I.C.I.), 0.2 ml/l of acetic acid, and 1 g/l of a dispersing agent mainly containing a condensation product of naphthalene sulfonic acid with formamide. The fabric was then soaped with an aqueous solution containing a nonionic detergent at a temperature of 80° C for 20 minutes, and dried at a temperature of 120° C for 3 minutes.

The dyed fabric was finished with a polyurethane in the following manner. The fabric was immersed in a 3.6% by weight aqueous emulsion of a mixture of 2.3% by weight polyurethane (reaction product of methylene-diphenyldiisocyanate, polyethylene glycol, and 1,4-butane diol), 1.0% by weight polybutyl acrylate, and 0.3% by weight of a polyester-polyether block copolymer (a block copolymer consisting of 40% by weight of a polyester of terephthalic acid and 1,4-butane diol, and 60% by weight of polytetramethyleneglycol). The fabric was then squeezed to an emulsion pick-up ratio of 70% based on the weight of the fabric and dried at a temperature of 120° C for 3 minutes, after which it was heat-set at a temperature of 150° C for 30 seconds. The fabric was buffed one time by a roller sander machine with sand paper of 100 mesh size, followed by brushing.

The average monofilament denier of the raised portion of the resultant raised woven fabric was 0.23 denier, and that of the unraised portion of the weft yarn was 0.45 denier. The resultant raised woven fabric was a suede-like raised woven fabric having a high density and excellent uniformity of the raised fibers, and also having excellent suppleness (high bending stiffness and bending resilience), and surface abrasion and pilling resistances. The results of testing the physical properties of this fabric were as shown in Table I below:

TABLE I

| Test | Unit of Measurment | Example 1 | Example 2 | Example 3 |
|---|---|---|---|---|
| Density of finally finished fabric (1) | No./inch | (warp)(weft) 118 69 | (warp)(weft) 116 68 | (warp)(weft) 115 68 |
| Thickness of fabric (2) | mm | 0.87 | 0.87 | 0.83 |
| Weight of fabric (3) | $g/m^2$ | 312 | 309 | 301 |
| Weight of polymer applied (4) | Wt% based on weight of fabric | 2.8 | 2.8 | 2.8 |
| Degree of bulkiness (5) | $cm^3/g$ | 2.8 | 2.8 | 2.7 |
| Bending stiff-ness *1 (6) | g | 6.5 | 7.2 | 8.0 |
| Bending resili-ence *1 (7) | % | 55 | 51 | 50 |
| Tear strength (weft) (8) | Kg | 1.8 | 2.0 | 2.2 |
| Air perme-ability (9) | $cc/cm^2/sec$ | 7.1 | 9.9 | 8.7 |
| Surface Abrasion (10) | *2 | excellent | excellent | excellent |
| Pilling test (ICI method) (11) | *3 | 4 – 5 | 4 – 5 | 4 – 5 |
| Writing effect (Finger-marks) (12) | *4 | excellent | excellent | excellent |
| Density of raised fine fibers (13) | $g/m^2$ *5 | 12.8 | 12.5 | 11.6 |
| Uniformity of raised fine fibers (14) | *6 | excellent | excellent | good |

| | Comparative Example 1 | Comparative Example 2 | Comparative Example 3 | Comparative Example 4 | Example 6 |
|---|---|---|---|---|---|
| (1) | (warp)(weft) 120 69 | (warp)(weft) 111 66 | (warp)(weft) 116 67 | (warp)(weft) 118 52 | (warp)(weft) 165 67 |
| (2) | 0.92 | 0.77 | 0.90 | 0.81 | 0.46 |
| (3) | 328 | 297 | 318 | 256 | 237 |
| (4) | 2.8 | 2.8 | 2.8 | 2.8 | 2.0 |
| (5) | 2.8 | 2.6 | 2.8 | 3.2 | 1.9 |
| (6) | 4.8 | 9.0 | 14 | 4.2 | 5.1 |
| (7) | 52 | 48 | 55 | 50 | 45 |
| (8) | 1.3 | 2.5 | 2.3 | 2.2 | 1.6 |
| (9) | 4.9 | 8.8 | 7.1 | 21.7 | 3.2 |
| (10) | good | excellent | excellent | good | excellent |
| (11) | 2 | 4 – 5 | 4 – 5 | 3 | 4 – 5 |
| (12) | good | poor | poor | excellent | excellent |
| (13) | 12.9 | 8.1 | 7.1 | 13.2 | 12.1 |

TABLE I-continued

| | | | | | |
|---|---|---|---|---|---|
| (14) | good | poor | poor | good | excellent |

*1 Method of measuring bending stiffness and resilience, (FIG. 5) A test piece 5 having a length of 5 cm and a width of 2 cm is cut out from the raised woven fabric. The test piece 5 is set in a sample holder 6 fixed on the cross head 7 of an Instron Tensile Tester as shown in FIG. 5-a. The distance between the wedge 8 of load cell 9 and the sample holder 6 is 2 cm as shown in FIG. 5-a. The sample holder 6 is moved upwards by 1.5 cm from the original position as shown in FIG. 5-b and thereafter is moved downwards by 1.5 cm. The relationship between the distance moved and the repulsive force of the test piece is recorded by the recorder 10 of the Instron Tensile Tester, and a chart as shown in FIG. 5-c is obtained. In FIG. 5-c, bending stiffness is read as a gram value at $p_1'$ and bending resilience is calculated from the repulsive forces at $H_1'$ and $H_2'$ using the following equation: Bending resilience = repulsive force at $H_2'$/repulsive force at $H_1'$ × 100(%) ($H_0$ is the middle of the distance between $P_0$ and $P_1''$).

*2 Change of appearance of fabric evaluated by the naked eyes when two surfaces of the fabric were rubbed against each other 5000 times:
excellent - change of appearance scarcely occurred
good - change of appearance slightly occurred
poor - change of appearance considerably occurred

*3 Grade evaluated by the naked eyes:
5 - pilling scarcely occurred
4 - pilling slightly occurred
3 - pilling appreciably occurred
2 - pilling considerably occurred
1 - pilling exorbitantly occurred

*4 Finger-marks evaluated by the naked eyes (when a finger is passed on the surface of the raised fabric having naps, the naps are along the direction of the finger pass):
excellent - finger-marks appear remarkably
good - finger-marks appear considerably
poor - finger-marks appear slightly

*5 Weight of raised fine fibers (naps) existing per square meter.

*6 Appearance of the raised surface evaluated by the naked eyes:
excellent - thread entangle-pattern by weaving is scarcely conspicuous
good - thread entangle-pattern by weaving is slightly conspicuous
poor - thread entangle-pattern by weaving is considerably conspicuous

EXAMPLES 2 AND 3, COMPARATIVE EXAMPLES 1 AND 2

Raised woven fabrics were obtained by the same procedure as in Example 1, except for varying the number of raising operations with the wire raising machine. The average monofilament denier of the unraised portion of the weft yarns of the resultant fabrics were respectively 0.31 (Comparative Example 1), 0.54 (Example 2), 0.72 (Example 3), and 0.87 (Comparative Example 2), corresponding to the raising operation being repeated 20, 12, 5 and 3 times, respectively. The average monofilament denier of the raised portion in each experiment was 0.23 denier.

The raised woven fabrics in Examples 2 and 3 had high density and excellent uniformity of the raised fibers, and also had excellent suppleness and surface abrasion and pilling resistances. The raised woven fabric in Comparative Example 1 did not have good suppleness (low bending stiffness), and its surface abrasion and pilling resistances were poor. The raised woven fabric in Comparative Example 2 had a rough feel (too high bending stiffness), and did not have a suede-like touch. Also, its writing effect and uniformity of raised fine fibers were poor. The results of testing the physical properties of these fabrics are as shown in Table I.

COMPARATIVE EXAMPLE 3

A raised woven fabric was obtained by the same procedure as in Example 1, except that the weft yarn was a twin filament yarn of hollow composite fibers and the raising operation was repeated 22 times. The twin filament yarn was produced by twisting two single filament yarns (each of which was a 150 denier/40 filament yarn having a twist number of Z 200 T/m) and a twist number of S 150 T/m. The average monofilament denier of the unraised portion was 0.45 denier and that of the raised portion was 0.23 denier.

The resultant fabric was low in density and poor in raised fiber uniformity, and did not have good suppleness. The results of testing the physical properties of this fabric were as shown in Table I.

COMPARATIVE EXAMPLE 4

A raised woven fabric was obtained by the same procedure as in Example 1, except that the weft yarn was a single twist filament yarn consisting of a bundle of extra fine fibers which were produced from an island-in-sea type composite fiber. The island-in-sea type composite fiber was produced according to the method disclosed in U.S. Pat. No. 3,865,678. The sea component was removed by washing the fabric with trichloroethylene 5 times before the raising operation. The particulars of the island-in-sea type composite fiber and the weft yarn used were as follows:

Polymer of island components: polyethylene terephthalate (The intrinsic viscosity determined in O-chlorophenol at a temperature 35° C is 0.62.)
Number of islands: 8
Weight percentage of island components: 60%
Denier of an individual island component: 0.24 denier
Polymer of sea component: polystyrene (The number-average molecular weight is about 50,000)
Weight percentage of sea component: 40%
Denier of individual composite fiber: 3.8 denier
Total denier of a weft yarn: 300 denier (80 filaments)
Twist number of a weft yarn: S 120 T/m The resultant fabric was poor in surface abrasion and pilling resistances, and did not have good suppleness. The results of testing the physical properties of this fabric were as shown in Table I.

EXAMPLE 4

The raised and dyed woven fabric in Example 1 was immersed in a 2.4% by weight aqueous emulsion of a mixture of 1.2% by weight of an ethylene-vinyl acetate copolymer (a copolymer of equivalent moles of each component), 0.9% by weight polybutyl acrylate, and 0.3% by weight of a polyester-polyether block copolymer as used in Example 1, and was squeezed to an emulsion pick-up ratio of 70% based on the weight of the fabric. Thereafter, the fabric was subjected to drying, heat-setting, buffing, and brushing as in Example 1.

The resultant fabric had excellent suppleness, surface abrasion and pilling resistances substantially the same as the raised woven fabric of Example 1.

EXAMPLE 5

Onto the back-side surface (the surface opposite the surface subjected to the raising operation) of the raised woven fabric obtained by the same procedure as in Example 1, there was coated by a knife coater a 20% by weight aqueous emulsion of polyurethane the same as was used in Example 1 in an amount of 50 g/m$^2$ (calculated in terms of polyurethane). The coated fabric was then dried at a temperature of 120° C for 3 minutes and was heat-set at a temperature of 160° C for one minute. Thereafter, the coated surface of the fabric was buffed one time by a roller sander machine with sand paper of 120 mesh size.

The resultant raised woven fabric had low air permeability, (0.3 cc/cm$^2$/sec), excellent suppleness, and excellent surface abrasion resistance. The writing effect of the fabric was also excellent.

EXAMPLE 6

As a warp yarn, there was used a 100 denier/48 filament loopy textured filament yarn of polyethlene terephthalate having a twist number of S 500 T/m. This warp yarn was produced from a 100 denier/48 filament, 0 twist yarn by passing the same through an air jet nozzle as disclosed in U.S. Pat. No. 2,783,609 and thereafter twisting the resultant yarn.

As a weft yarn, there was used a single twist filament yarn of hollow composite fibers as disclosed in Example 1.

A 4-ply satin was prepared from the warp and weft yarns, the woven density of which was 100 warps/inch and 57 wefts/inch. The resultant woven fabric was processed by the same procedure as in Example 1. The average monofilament denier of the raised portion of the resultant raised woven fabric was 0.23 denier, and that of the unraised portion was 0.43 denier. The obtained raised woven fabric had excellent properties substantially the same as the raised woven fabric of Example 1. The results of testing the physical properties of this fabric were as shown in Table I.

EXAMPLE 7

As a warp yarn, there was used a loopy textured filament yarn as disclosed in Example 6.

As a weft yarn, there was used a 150 denier/40 filament loopy textured filament yarn of the hollow composite fiber as disclosed in Example 1.

This loopy textured filament yarn was produced from two yarns each composed of a 75 denier/20 filament, 0 twist yarn produced by passing the same through an air jet nozzle as disclosed in U.S. Pat. No. 2,783,609, in which one yarn was supplied at a 30% over feed to the other yarn. This type of the loopy textured filament yarn is known as a core-effect yarn of the "Taslan" type.

A 4-ply satin was prepared from the warp and weft yarns, the woven density of which was 110 warps/inch and 88 wefts/inch.

The resultant woven fabric was processed by the same procedure as in Example 1, except that the number of raising operations was 12 times. The density of the finally finished fabric was 162 warps/inch and 99 wefts/inch. The average monofilament denier of the raised portion of the resultant raised woven fabric was 0.23 denier, and that of the unraised portion was 0.50 denier.

The obtained raised woven fabric had high density and excellent uniformity of the raised fibers, and also had high tear strength, excellent suppleness and surface abrasion and pilling resistances.

While the invention has been described in detail and with reference to specific embodiments thereof, it will be apparent to one skilled in the art that various changes and modifications can be made therein without departing from the spirit and scope thereof.

What is claimed is:

1. A suede-like raised woven fabric of interwoven warp yarns and weft yarns which comprises:

(a) a plurality of warp yarns, the total denier of a single warp yarn ranging from 50 to 300 denier;

(b) a plurality of weft yarns, a single weft yarn having a total denier of from 50 to 500 and being a single twist filament yarn, a loopy textured filament yarn or mixtures thereof, and constituted of a bundle of fine fibers obtained from hollow composite fibers, each composed of at least four alternating segments of fiber forming polyester and fiber forming polyamide components which are mutually adhered side-by-side and encompass a hollow space, and which extend along the longitudinal axis of the fiber to form a tubular body, said bundle of fine fibers having raised and unraised portions, the hollow composite fibers in the raised portions being separated into fine fibers having an average monofilament denier of from 0.05 to 0.4 denier and the hollow composite fibers in the unraised portions being separated into fine fibers having an average monofilament denier of above 0.4 but not exceeding 0.8 denier; and (c) an elastic polymer applied thereto.

2. The suede-like raised woven fabric according to claim 1, wherein the weft yarn is a single twist filament yarn.

3. The suede-like raised woven fabric according to claim 1, wherein the weft yarn is a loopy textured filament yarn.

4. The suede-like raised woven fabric according to claim 1, wherein the warp yarn is a textured filament yarn having crimps.

5. The suede-like raised woven fabric according to claim 1, wherein the warp yarn is a loopy textured filament yarn.

6. A process for the preparation of a suede-like raised woven fabric which comprises the steps of:

(1) providing hollow composite fibers, each composed of at least four alternately arranged components of fiber-forming polyester and fiber-forming polyamide which are mutually adhered side-by-side and encompass a hollow space, and which extend along the longitudinal axis of the fiber to form a tubular body, said composite fiber having a denier of from 1 to 10, and said each component having a denier of from 0.05 to 0.4;

(2) forming said hollow composite fibers into a yarn selected from the group consisting of a single twist filament yarn and a loopy textured filament yarn having a size of from 50 to 500 denier;

(3) weaving a fabric whose weft is the yarn comprising said hollow composite fibers and whose warp is a yarn having a size of from 50 to 300 denier;

(4) dividing said hollow composite fibers constituting said weft yarn into fine fibers to form a bundle of fine fibers by a raising operation, wherein said bundle of fine fibers consists of raised and unraised portions, the average monofilament denier of said raised portion being in the range of from 0.05 to 0.4 denier and the average monofilament denier of said unraised portion being in a range of above 0.4 but not exceeding 0.8 denier;

(5) applying a solution of an elastic polymer to said fabric; and (6) solidifying said elastic polymer.

7. The process according to claim 6, wherein the solution of elastic polymer is impregnated into said fabric.

8. The process according to claim 6, wherein the solution of elastic polymer is coated onto the back-side surface of said fabric.

9. The process according to claim 6, wherein the weft is a single twist filament yarn.

10. The process according to claim 6, wherein the weft is a loopy textured filament yarn.

11. The process according to claim 6, wherein the warp is a textured filament yarn having crimps.

12. The process according to claim 6, wherein the warp is a loopy textured filament yarn.

* * * * *